US006214264B1

(12) United States Patent
Aneja

(10) Patent No.: US 6,214,264 B1
(45) **Date of Patent: *Apr. 10, 2001**

(54) DRAWING OF POLYESTER FILAMENTS

(75) Inventor: Arun Pal Aneja, Greenville, NC (US)

(73) Assignee: E. I. du Pont de Nemours and Company, Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/342,080

(22) Filed: Jun. 29, 1999

Related U.S. Application Data

(60) Division of application No. 09/053,809, filed on Apr. 2, 1998, now Pat. No. 5,968,649, which is a continuation-in-part of application No. 08/662,804, filed on Jun. 12, 1996, now Pat. No. 5,736,243, which is a continuation-in-part of application No. 08/497,495, filed on Jun. 30, 1995, now Pat. No. 5,591,523, and a continuation-in-part of application No. 08/642,650, filed on May 3, 1996, now Pat. No. 5,626,961, which is a continuation-in-part of application No. 08/497,499, filed on Jun. 30, 1995, now abandoned.

(51) Int. Cl.[7] ..... D01D 5/088; D01D 5/12; D01D 5/253; D02G 3/00

(52) U.S. Cl. ..... 264/103; 264/177.13; 264/210.8; 264/211.14

(58) Field of Search ..... 264/290.5, 103, 264/177.13, 210.8, 211.14

(56) References Cited

U.S. PATENT DOCUMENTS

H1275 * 1/1994 Duncan .
2,071,251 * 2/1937 Carothers .
2,465,319 * 3/1949 Whinfield et al. .
3,335,211 * 8/1967 Mead et al. .
3,576,773 * 4/1971 Vaginay .
4,092,299 * 5/1978 MacLean et al. .
4,113,704 * 9/1978 MacLean et al. .
4,833,032 * 5/1989 Reese .
4,945,151 * 7/1990 Goodley et al. .
4,966,740 * 10/1990 Reese .
5,034,174 * 7/1991 Reese .
5,188,892 * 2/1993 Grindstaff .
5,417,902 * 5/1995 Bennie et al. ..... 264/103
5,591,523 * 1/1997 Aneja .
5,626,961 * 5/1997 Aneja .
5,736,243 * 4/1998 Aneja .

FOREIGN PATENT DOCUMENTS

294912 * 12/1988 (EP) .
WO92/13120 * 8/1992 (WO) .
WO97/2372 * 1/1997 (WO) .
WO97/2373 * 1/1997 (WO) .
WO97/2374 * 1/1997 (WO) .

OTHER PUBLICATIONS

Marshall and Thompson, Drawing Synthetic Fibers, *Nature*, 171, 38 and 39, Jan. 3, 1953.

Marshall and Thompson, The Drawing of Terylene, *J. Applied Chem.,* 4, 145 Through 153, Apr., 1954.

Marshall and Thompson, The Cold Drawing of High Polymers, Proc. Roy. Soc. (London), A221, 541 Through 557 (Undated).

* cited by examiner

*Primary Examiner*—Leo B. Tentoni

(57) ABSTRACT

Simultaneous drawing of mixed polyester filaments is improved by use of chain-branched polyester for the polymer from which the polyester filaments are spun.

6 Claims, 6 Drawing Sheets

DRAWING OF POLYESTER FILAMENTS

CROSS-REFERENCE TO RELATED APPLICATION

This application is a division of my application Ser. No. 09/053,809, filed Apr. 2, 1998, now U.S. Pat. No. 5,968,649, which is a continuation-in-part of my application Ser. No. 08/662,804 , filed Jun. 12, 1996, and now U.S. Pat. No. 5,736,243, being itself a continuation-in-part of my earlier application Ser. Nos. 08/497,495 , filed Jun. 30, 1995, and now U.S. Pat. No. 5,591,523 and Ser. No. 08/642,650 , filed May 3, 1996, and now U.S. Pat. No. 5,626,961, itself a continuation-in-part of my earlier application Ser. No. 08/497,499, filed Jun. 30, 1995, now abandoned, and also deriving priority benefit from PCT/US98/06153, filed Mar. 31, 1998 and from PCT/US98/06154, filed Mar. 31, 1998.

FIELD OF INVENTION

This invention concerns improved drawing of polyester filaments, and more particularly a process for drawing mixed polyester filaments in the same bundle, especially drawing a tow of such mixed filaments, and the resulting drawn filaments and bundles and downstream processes therefor and products thereof.

BACKGROUND OF INVENTION

Polyesters have been produced commercially on a large scale for processing into shaped articles such as fibers, primarily from poly(ethylene terephthalate). Synthetic polyester yarns have been known and used commercially for several decades, having been first suggested by W. H. Carothers, U.S. Pat. No. 2,071,251, and then Whinfield and Dickson suggested poly(ethylene terephthalate) in U.S. Pat. No. 2,465,319.

Although many polyester polymers (including copolymers) have been suggested, the polyester most widely manufactured and used hitherto for textile fibers has been poly(ethylene terephthalate), which is often referred to as homopolymer PET. Homopolymer PET has generally been preferred over copolymers because of its lower cost, and also because its properties have been entirely adequate, or even preferred, for most end-uses. It is known, however, that homopolymer PET requires special dyeing conditions (high temperature requiring super-atmospheric pressure) not required for nylon fibers, for example, so copolyesters have been suggested and used commercially for some purposes. Homopolymer PET is often referred to as 2G-T, while poly(trimethylene terephthalate) is referred to as 3G-T (although some have started calling this PTT), and poly (tetramethylene terephthalate) is referred to as 4G-T, and so on. Some interest has been shown in 3G-T, and also in 4G-T, but 2G-T is the polyester polymer that has so far been used the most, so is discussed mostly hereinafter, but it will be understood that the invention is expected to apply also to other polyesters, for instance other $C_2$-$C_4$ alkylene terephthalates, such as 3G-T and 4G-T mentioned above, and copolyesters.

Polyester fibers are either (1) continuous filaments or (2) fibers that are discontinuous, which latter are often referred to as staple fiber or cut fibers, and are made by first being formed by extrusion into continuous polyester filaments, which are processed in the form of a tow of continuous polyester filaments before being converted into staple. An important stage in the processing of such continuous polyester filaments has been "drawing" to increase the orientation of the long chain polyester molecules, and thereby improve the properties of the filaments. The present invention relates to improvements in this drawing stage and to the improved products resulting therefrom.

Mostly, the objective of synthetic fiber producers has been to replicate advantageous properties of natural fibers, the most common of which have been cotton and wool fibers.

Most of the polyester cut fiber has been of round cross-section and has been blended with cotton. Recently, however, U.S. Patents Nos. 5,591,523 (DP-6255) and 5,626,961 (DP-6365-A) and copending application Ser. No. 08/662,804 (DP-6400) filed Jun. 12, 1996, and now allowed, corresponding respectively to WO 97/02372, WO 97/02373 and WO 97/02374, the disclosures of which are hereby incorporated herein by reference, have disclosed inventions relating to polyester tows that are suitable for conversion to slivers on a worsted or woollen system and downstream processing on such systems, eventually into fabrics and garments. The present invention has been made in the course of that work, so is described with particular reference to its value in drawing polyester filaments in tows for further processing in such systems, but is not confined to drawing such tows and is believed to have potential for use more broadly when drawing other bundles of polyester filaments.

As, for example, has been disclosed in U.S. Pat. No. 5,591,523 (DP-6255), filaments of different denier per filament (dpf) have sometimes been desired, so surprise was expressed in Example 1 of that patent that it was possible to spin undrawn polyester filaments that had been spun of significantly different denier on the same spinning machine without adjusting the natural draw ratio and then subsequently to draw an intimate mixture of these spun filaments simultaneously in the same tow at the same draw ratio to provide filaments with excellent properties that were different because of their differing dpfs (col 6, lines 15–29). The present invention expands on this surprising finding and extends it to the drawing simultaneously of other mixed filament bundles beyond the mixed filament tows specified in that patent.

SUMMARY OF THE INVENTION

According to one aspect of the invention, there is provided a process of drawing a mixture of polyester filaments in the same bundle of polyester filaments, wherein said mixture is a mixture of different cross-sections and/or of different deniers per filament, and wherein said polyester is chain-branched with about 0.1 to about 0.8 mole % of chain-brancher; such mole % is calculated conventionally as the molecular weight of the chain-brancher unit divided by the molecular weight of the polymer repeat unit times 100, the repeat unit for 2G-T being ethylene terephthalate by way of example.

According to another aspect of the invention, there is provided a mixture of polyester filaments, wherein said mixture is a mixture of different cross-sections and/or of different deniers per filament, wherein said polyester is chain-branched with about 0.1 to about 0.8 mole % of chain-brancher, and wherein the shrinkage is about 0.5 to about 3%. Such mixtures may be in the form of continuous filamentary drawn tows and drawn yarns, and downstream products of mixtures of polyester filaments resulting therefrom, including mixtures of staple (cut) fiber in various forms, including yarns, and fabrics and garments as well as the yarns themselves, and it will be understood that the resulting mixtures of polyester fibers may also be mixed with other fibers, such as of other synthetic polymers, including polyamides (nylons of various types) and polyolefins, for example, and/or natural fibers, such as cotton and wool.

The terms "filament" and "fiber" are used inclusively herein, and are not generally intended to be mutually exclusive; sometimes, however, these general terms are modified, as in terms such as "continuous filament" and "staple fiber".

Significantly, as will be explained in relation to the stress-strain curves in the Examples, no natural draw ratio has been found when drawing simultaneously according to the invention. Also, no neck drawing has been experienced in contrast to our experience when drawing filaments of homopolymer 2G-T.

DETAILED DESCRIPTION

Figure 1:
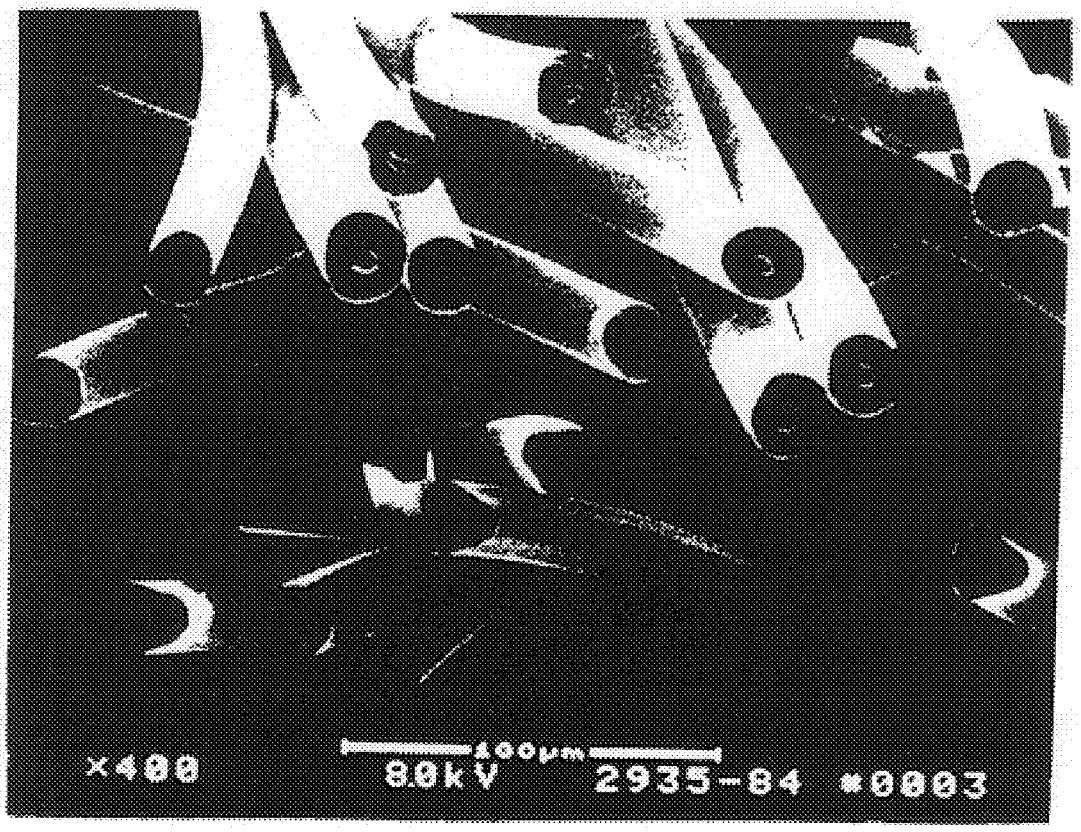
FIG. 1 is a magnified photograph of mixed filament cross-sections according to the invention as explained hereinafter in greater detail.

It would be redundant to repeat what has already been disclosed in the art. As has been indicated, the preparation of polyester polymers and spinning of filaments therefrom has been disclosed in the art. The drawing of polyester filaments has also been disclosed in many references dating back to those by Marshall and Thompson in Nature, Vol. 171 (Jan. 3, 1953), pages 38–39, *"Drawing Synthetic Fibers"*, in J. Applied Chem., 4 (April 1954), pages 145–153 *"The Drawing of Terylene"*, and in Proc. Roy. Soc. (London), Vol. A221, pages 541–557, *"The Cold Drawing of High Polymers"*. As indicated hereinbefore, the present invention was made during work on drawing polyester filaments in tows that were being developed for worsted and woollen processing, so much of the detailed description herein relates to such filaments and tows, but the inventive concept has wider application.

As indicated, the essence of the invention is the use of chain-branched polyester polymer to make the polyester filaments that are drawn according to the process of the invention to provide the mixtures of filaments according to the invention. The use of chain-branchers (i.e., multifunctional, polyester-forming intermediates having more than the requisite two functional groups that are required for polymerization, such as a glycol and a dibasic acid, both of which are difunctional) has been disclosed in art such as MacLean et al, U.S. Pat. Nos. 4,092,299 and 4,113,704, Mead et al in U.S. Pat. No. 3,335,211, Oxford et al WO 92/13,120, Duncan, U.S. SIR H1275, DuPont (Broaddus et al) EPA2 294,912, Reese, U.S. Patent Nos. 4,833,032, 4,966,740 and 5,034,174, Goodley et al in U.S. Pat. No. 4,945,151, and art referred to and cited therein, such as Vaginay, U.S. Pat. No. 3,576,773. Some of these references used different terminology, such as viscosity builders, because the materials were added to enhance spinning performance, or for other reasons. Much of this prior art related to high-speed spinning of continuous filament yarns as feed yarns for draw-texturing, so those continuous filaments were spin-oriented, rather than amorphous, such as are more suited for drawing in tow form for conversion into cut fiber, which is of special interest and preference according to the present invention. The low shrinkage of the mixtures of filaments according to the invention distinguishes our drawn filaments from the filaments of higher shrinkage made by high speed spinning to make spin-oriented filaments for use as feed yarns for draw-texturing, often referred to as POY. The shrinkage is the boil off shrinkage that is referred to at the bottom of col 6 of Knox U.S. Pat. No. 4,156,071, and is measured in the manner described there by Knox.

As indicated, U.S. Pat. No. 5,591,523 and WO 97/02372 have already disclosed in Example I the simultaneous drawing of a tow of polyester filaments of mixed dpf and that it was surprising that this could be accomplished to give drawn filaments that were satisfactory and with no dark dye defects. Such a process and the resulting drawn filaments of mixed dpf, all of scalloped-oval cross-section, have already been disclosed therein. In addition, U.S. Pat. No. 5,629,961 and WO 97/02373 have disclosed filaments of improved scalloped-oval cross-section with 6 grooves, and have incorporated the disclosure of U.S. Pat. No. 5,591,523, as did WO 97/02374 and allowed U.S. application No. 08/662,804. It follows that the present application is particularly concerned with additional aspects of the concept of the invention that are not already covered in these previous patents and patent applications. Such additional aspects are now mentioned; namely, mixtures of filaments of differing cross-sections that are not entirely of scalloped-oval cross-section, such as one cross-section being round while the other cross-section is non-round, for instance trilobal, ribbon-shaped or even scalloped-oval; mixtures of more than one non-round different cross-section, such as any mixture of such non-round cross-sections; mixtures of solid filaments and of filaments with one or more longitudinal voids, one void being often referred to as a hollow filament, but also multi-void filaments with, e.g., 3 or 4 voids, or with 7 voids, as disclosed, e.g., in U.S. Pat. Nos. 3,745,061, 3,772,137 and 5,104,725, and art referred to and cited therein; so far as terminology herein is concerned, such filaments with longitudinal voids are embraced herein technically within the concept of "non-round" filaments since their previous behavior during drawing (when made of 2G-T homopolymer without chain-brancher) has differed from the behavior of round (solid) filaments (made similarly without chain-brancher); also mixtures of filaments of dpfs that differ, even when of the same cross-section (other than all being scalloped-oval cross-section as mentioned hereinbefore), but also of different cross-section and of different dpf; such dpf differences may be such that a higher dpf is at least 1.1× a lower dpf, or larger differences, such as at least 1.2×, 1.3× or 1.5× or more.

As will be seen in the Examples hereinafter, it is difficult to predict the dpfs and properties of the drawn filaments that are obtained by drawing mixtures of filaments according to the invention.

The invention is further illustrated in the following Examples, which, for convenience, refer to processing on the worsted system, as explained hereinabove. All parts and percentages are by weight unless otherwise indicated. The boil off shrinkages of the products for all the Examples were in the range of 1% to 1.5%.

Most test procedures are well-known and/or described in the art. For avoidance of doubt, the following explanation of procedures that were used are given in the following paragraphs.

Instron. The average stress-strain curves were obtained as follows as an average of 10 individual filaments of each type taken from the tow bundle. Ten samples of each type of filament were separated from the tow bundle using a magnifying glass (LUXO Illuminated Magnifier). The denier per filament (DPF) of each sample filament was measured on a VIBROSCOPE (HP Model 201C Audio Oscillator). The sample filaments were mounted one at a time on an INSTRON (Model 1122 or 1123) and the stress-strain behavior was measured. Ten breaks were recorded for each filament type, and the average of the 10 samples was recorded for each filament type so, as will readily be understood, values read from a stress-strain curve of an individual filament do not necessarily correlate with tensile properties calculated and listed as an average in the Tables.

Units—Measurements were made using conventional U.S. textile units, including denier, which is a metric unit. To meet prescriptive practices elsewhere, dtex and CPcm equivalents of the DPF and CPI measurements are given in parentheses after the actual measurements. For the tensile measurements (MOD, for initial modules, and TEN, for tenacity), however, the actual measurements in gpd have been converted into g/dtex and these latter have been given in the Tables, whereas the stress-strain curves in the Figures show original metric tensile values on the Y-axis.

Crimp Frequency was measured as the number of crimps per inch (CPI) after the crimping of the tow. The crimp is exhibited by numerous peaks and valleys in the fiber. Ten filaments are removed from the tow bundle at random and positioned (one at a time) in a relaxed state in clamps of a fiber-length measuring device. The clamps are manually operated and initially moved close enough together to prevent stretching of the fiber while placing it in the clamp. One end of a fiber is placed in the left clamp and the other end in the right clamp of the measuring device. The left clamp is rotated to remove any twist in the fiber. The right clamp support is moved slowly and gently to the right (extending the fiber) until all the slack has been removed from the fiber but without removing any crimp. Using a lighted magnifier, the number of peaks on top and bottom side of the fiber are counted. The right clamp support is then moved slowly and gently to the right until all the crimp has just disappeared. Care is taken not to stretch the fiber. This length of the fiber is recorded. The crimp frequency for each filament is calculated as:

$$\frac{\text{Total Number of Peaks}}{2\times\text{Length of Filament (uncrimped)}}$$

The average of the 10 measurements of all 10 fibers is recorded for the CPI (crimps per inch), the metric equivalent being CPcm.

CTU (Crimp Take Up) was also measured on tow and is a measure of the length of the tow extended, so as to remove the crimp, divided by the unextended length (i.e., as crimped), expressed as a percentage, as described in Anderson et al, U.S. Pat. No. 5,219,582.

Values for non-round fiber cross sections were obtained using the following procedure. A fiber specimen is mounted in a Hardy microtome (Hardy, U.S. Department of Agriculture circa 378, 1933) and divided into thin sections according to methods essentially as disclosed in "Fiber Microscopy Its Technique and Applications" by J. L. Sloves (van Nostrand Co., Inc., New York 1958, No. 180-182). Thin sections are then mounted on a super FIBERQUANT video microscope system stage (Vashaw Scientific Co., 3597 Parkway Lane, Suite 100, Norcross, Ga. 30092) and displayed on the Super FIBERQUANT CRT under magnifications as needed. The image of an individual thin section of one fiber is selected and critical fiber dimensions measured. The ratios are then calculated. This process is repeated for each filament in the field of view to generate a statistically significant sample set, and the averages are given herein. Aspect Ratios or Modification Ratios for the non-round cross-sections are given in the Tables in parentheses after indication of the type of cross-section, e.g., "SO (1.37)" indicates a scalloped-oval cross-section of Aspect Ratio 1.37. Similarly void contents are given in parentheses after indication of a hollow cross-section, e.g., a void content of 7% is shown as "Hollow (7%)", being measured as described by Aneja et al. in U.S. Pat. No. 5,532,060.

Relative Viscosity (LRV) is the viscosity of polymer dissolved in HFIP solvent (hexafluoroisopropanol) containing 100 ppm of 98% reagent grade sulfuric acid. The viscosity measuring apparatus is a capillary viscometer obtainable from a number of commercial vendors (Design Scientific, Cannon, etc.). The relative viscosity in centistokes is measured on a 4.75 wt. % solution of polymer in the solvent at 25° C. The $H_2SO_4$ used for measuring LRV destroys cross-links, specifically silicon in the case of tetraethyl ortho silicate chain-brancher.

Non-Acid Relative Viscosity (NRV) is the viscosity of polymer similarly dissolved, measured and compared in hexafluoro-isopropanol solvent but without any sulfuric acid. Since the acid is not present, the cross-links are left intact when the NRV is measured.

Delta RV (ΔRV) is the expression we have used herein to define the difference between the NRV and the LRV measured as described above, and express the amount of cross-linking destroyed by the acid when measuring LRV.

Product Defects are classified herein in three categories:

1) Equivalent Fabric Defects (EFD),

2) Dark Dye Defects (DDD),

3) Splinters (SPL).

The first two defects (EFD and DDD) are fibers and clumps of fibers that dye darker than normal fibers. DDDs have a diameter less than 4× the normal (drawn) fiber diameter. EFDs have a diameter 4× the normal fiber diameter or greater. Both defects must be longer than 0.25 inch (6.35 mm). Samples are processed through a roller top type card. The sliver is dyed light blue and examined visually under a lighted magnifying glass. Fibers that dye darker than the bulk of the sample are removed, classified as EFDs or DDDs and counted. Each type of defect is reported as number of defects per 0.1 pounds (0.045 Kg) sliver. Splinters are oversized fibers or clumps of fibers. To be classified as a splinter, this defect must also be longer than 0.25 inch (6.35 mm) but its total diameter must be greater than 0.0025 inch (0.0635 mm). Splinters are concentrated in the flat strip waste when a staple sample is processed through a flat card. The flat strip waste is visually examined against a black background. Splinters are removed, classified by size, counted, and expressed on a weight of sample basis.

EXAMPLE 1

Figure 2:
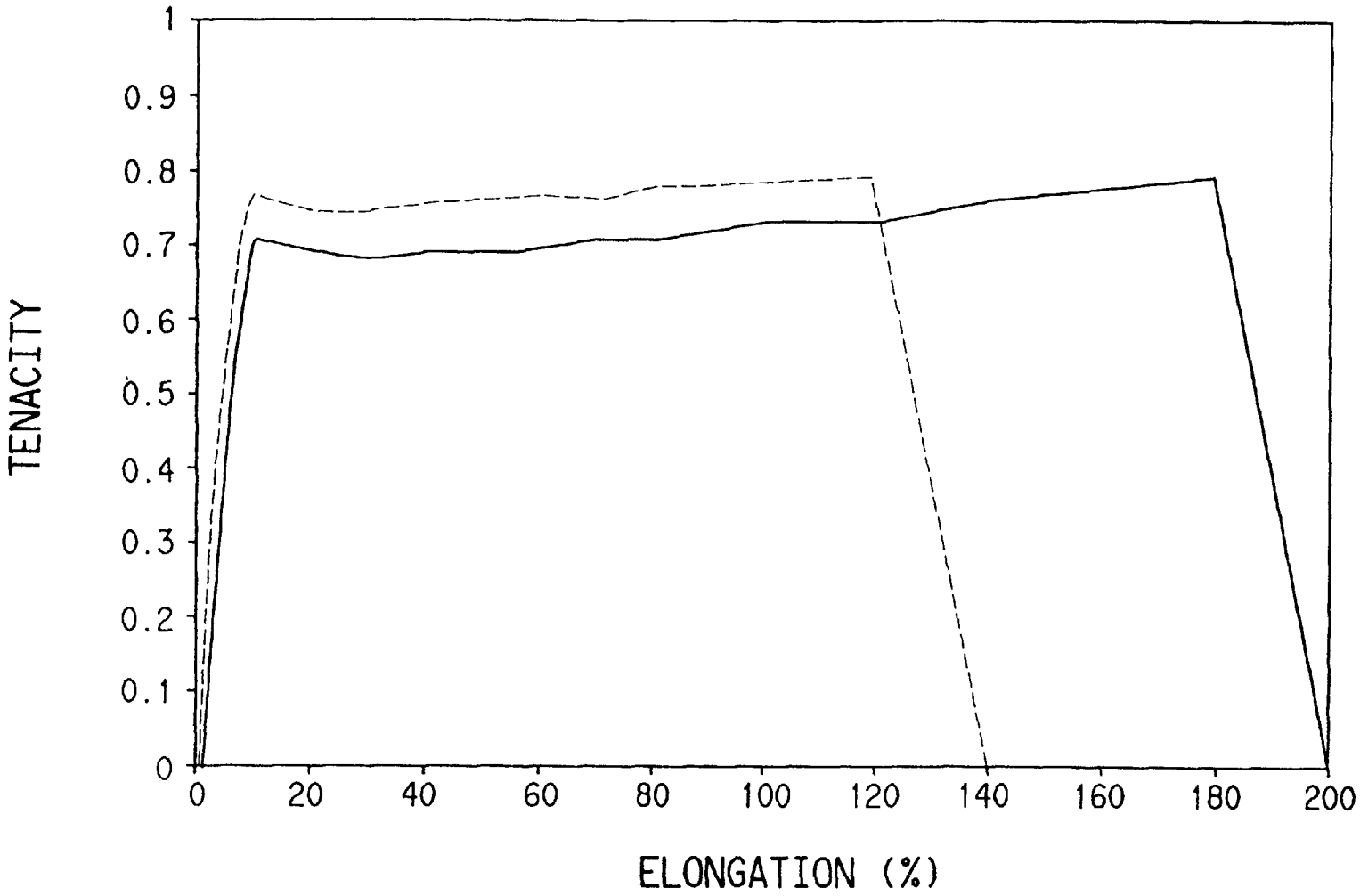
FIGS. 2 to 6 are average stress-strain curves of single filaments for use in mixtures according to the invention, as described more specifically hereinafter.

Mixed filaments were melt spun at 282° C. from chain-branched ethylene terephthalate polymer, such mixed filaments being a mixture of light filaments (finer denier) of scalloped-oval (SO) cross-section and of heavy filaments (heavier denier) of round cross-section. The different filaments were melt-spun simultaneously through different capillaries in the same spinneret, each containing 1000 capillaries, from polymer containing 0.24% (0.22 mole %) tetraethyl silicate (TES, essentially as described in Mead et al., U.S. Pat. No. 3,335,211) and having 10.2 LRV and 15.3 NRV (so 5.1 ΔRV), at a total of 23.68 rate lbs/hr (10.75 Kg/hr) for each spinneret, and wound on bobbins at 1800 ypm (1650 m/min). The spinnerets had 516 round capillaries, each of flow area 0.0003079 sq. in. (0.199 $mm^2$) to make heavy filaments (round cross-section), and 484 non-round capillaries each of flow area 0.0002224 sq. in (0.143 $mm^2$), to make light filaments (scalloped-oval cross-section). The smaller non-round capillaries were located on the inner five (of 9) rings while the larger round capillaries were located on the outer four rings of the spinneret. The orifice shape for the scalloped-oval capillaries was essentially as described in U.S. application Ser. No. 08/662,804 (DP-6400) and WO 97/02374 referred to hereinbefore. The molten filamentary streams were quenched using radially-directed air from a profiled quench system, as described in Anderson, et al., U.S. Pat. No. 5,219,582. The resulting spun filament bundle consisted of a mixture of different cross-sections and of lower and higher denier filaments with properties indicated in Table 1A. Stress-strain curves of single filaments of the two different types of filaments are shown in FIG. 2, the continuous curve being for a lower denier (light) filament of scalloped-oval (SO) cross-section, and the interrupted curve being for a higher denier (heavy) round filament.

TABLE 1A

| Filament | | | | | |
|---|---|---|---|---|---|
| Type | Shape | DPF | Mod | Ten | $E_B$ % |
| Light | SO (1.37) | 1.6 (1.8) | 12.2 | 0.7 | 170 |
| Heavy | Round | 2.7 (3.0) | 13.8 | 0.7 | 131 |

Sixty-eight bobbins of the as-spun mix ed filaments were combined to form a tow with a nominal blend ratio of 40% scalloped-oval shape, lower dpf, and 60p round, higher dpf, filaments. This tow was drawn at a draw ratio of 2.22× while sprayed with water at 95° C. The tow was then passed through a stuffer box crimper and subsequently relaxed at 145° C. to give a final tow size of approximately 74,800 denier (83,100 dtex) of an intimate blend of crimped filaments (10.6 CPI, 4.2 CPcm) of both types of filaments whose properties are listed in Table IB.

TABLE IB

| | Shape | Blend | DPF | Mod | Ten | $E_B$ % |
|---|---|---|---|---|---|---|
| Light dpf | SO (1.24) | 40 | 0.98 (1.1) | 28.7 | 1.1 | 9 |
| Heavy dpf | Round | 60 | 1.19 (1.3) | 32.0 | 1.7 | 12 |

A conventional finish was applied to provide a finish level (on fiber) of 0.15%. The nominal denier per filament (i.e., the denier of the total tow bundle divided by the number of filaments) was 1.1 dpf (1.3 dtex), about 40% of the filaments being of scalloped-oval shape (0.98 denier) and the remaining 60a of round shape (1.19 denier).

The product was processed and then scrutinized for Product Defects, EFD, DDD and SPL, all of which registered as zero Defects, so it is clear that the product quality was not adversely impacted by simultaneously drawing a mixture of different shapes and deniers of as-spun filaments, which was surprising and contrary to previous experience in attempts to process filaments of mixed shape and mixed denier made essentially similarly from homopolymer without chain-brancher, as will be related now.

Comparisons

In contrast, when four mixtures of different filaments of homopolymer 2G-T without any chain-brancher were drawn similarly in the same bundles, significant Product Defects were noted when the drawn bundles were processed and scrutinized, as indicated in Table C2. The draw ratios are indicated as "DR" in Table C2. Each mixture that was drawn together was a mixture of two types of filaments out of four types CA, CB, CC and CD, whose properties are shown in Table C1. The filaments were spun separately from the homopolymer 2G-T without any chain-brancher (LRV 20.4), but otherwise essentially as described for Example 1.

TABLE C1

| Item | Shape | DPF | Mod | Ten | $E_B$ % | NDR |
|---|---|---|---|---|---|---|
| CA | SO (1.7) | 3.1 (3.4) | 15.4 | 1.8 | 199 | 1.9 |
| CB | SO (1.7) | 10.4 (11.5) | 17.6 | 1.6 | 278 | 1.7 |
| CC | Round | 7.4 (8.2) | 16.6 | 1.6 | 245 | 1.9 |
| CD | SO (1.7) | 7.4 (8.3) | 17.3 | 1.7 | 231 | 1.9 |

TABLE C2

| Mixture | DR | EFD | DDD |
|---|---|---|---|
| CA/CB | 2.4X | 148 | 57 |
| CA/CB | 2.8X | 108 | 54 |
| CC/CD | 2.7X | 0 | 45 |
| CC/CD | 3.0X | 0 | 27 |

Figure 3:
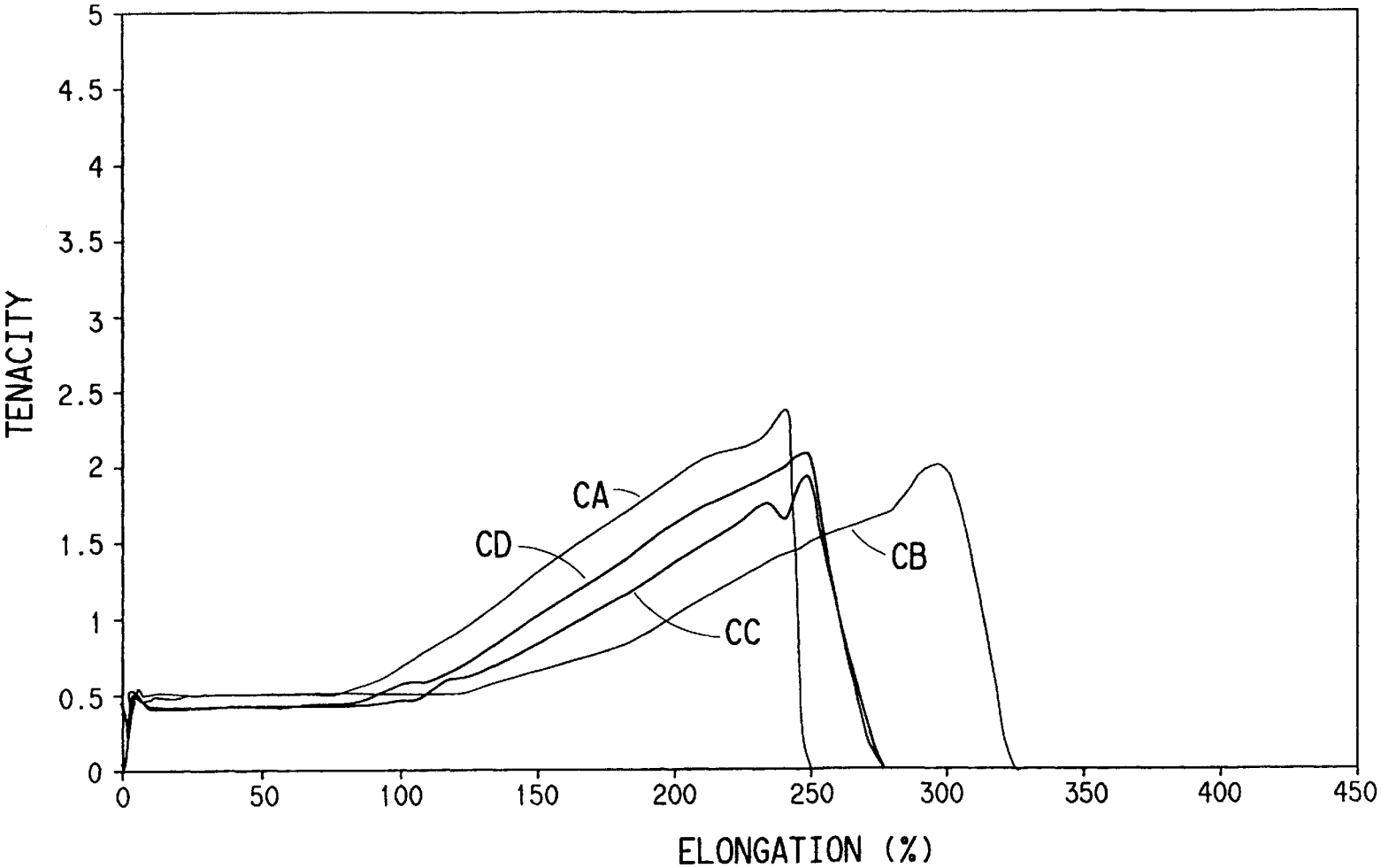

The significant numbers of Product Defects resulting from drawing such mixed filaments of homopolymer (CA/CB being mixtures of filaments of different deniers, but both of scalloped-oval cross-section of modification ratio 1.7, and CC/CD being mixtures of filaments of the same denier, but one being round and the other of scalloped-oval cross-section of modification ratio 1.7) contrast with the zero Product Defects obtained from Example 1 and from other Examples, according to the invention. Stress-strain curves of single filaments of these four types of homopolymer, CA, CB, CC and CD, are shown in FIG. 3, and may be contrasted with the curves in FIG. 2 and in FIGS. 4–6 for filaments of chain-branched polymer. Those in FIG. 3 all have significant flat portions that indicate a natural draw ratio for these homopolymer filaments, as was well known. Their natural draw ratios are listed as "NDR" in Table Cl. As can be seen, the natural draw ratios for CC and CD are both 1.9×, i.e., are both the same, but simultaneous drawing of mixtures of CC and CD gave significant numbers of Dark Dye Defects. The curves in FIG. 2 do not show corresponding flat portions; this can explain, in retrospect, why such filaments can be drawn together and give products without Product Defects, in contrast with the unsatisfactory prior experience in simultaneous drawing of most mixed deniers and/or cross-sections (because the filaments were of the homopolymer).

EXAMPLE 2

A mixture of three types of filaments, having different cross-sections but all of 7.6 dpf (8.4 dtex), was made by spinning each type separately at 282° C. from polymer containing 0.27% TES, 8.9 LRV and 15.4 NRV (6.5 ΔRV), at 1600 ypm (1460 m/min), but otherwise essentially as described for Example 1, to give as-spun filaments whose properties are given in Table 2A. The round filaments were extruded at a rate of 85.2 lbs/hr (38.7 Kg/hr) from a 520 capillary spinneret. The hollow filaments were extruded at a rate of 80.4 lbs./hr (36.5 Kg/hr) from a 490 capillary spinneret, using an orifice shape essentially as described in FIG. 5B of U.S. Pat. No. 5,356,582. The scalloped-oval filaments were extruded at a rate of 73.8 lbs/hr (33.5 Kg/hr) from a 450 capillary spinneret.

Figure 4:
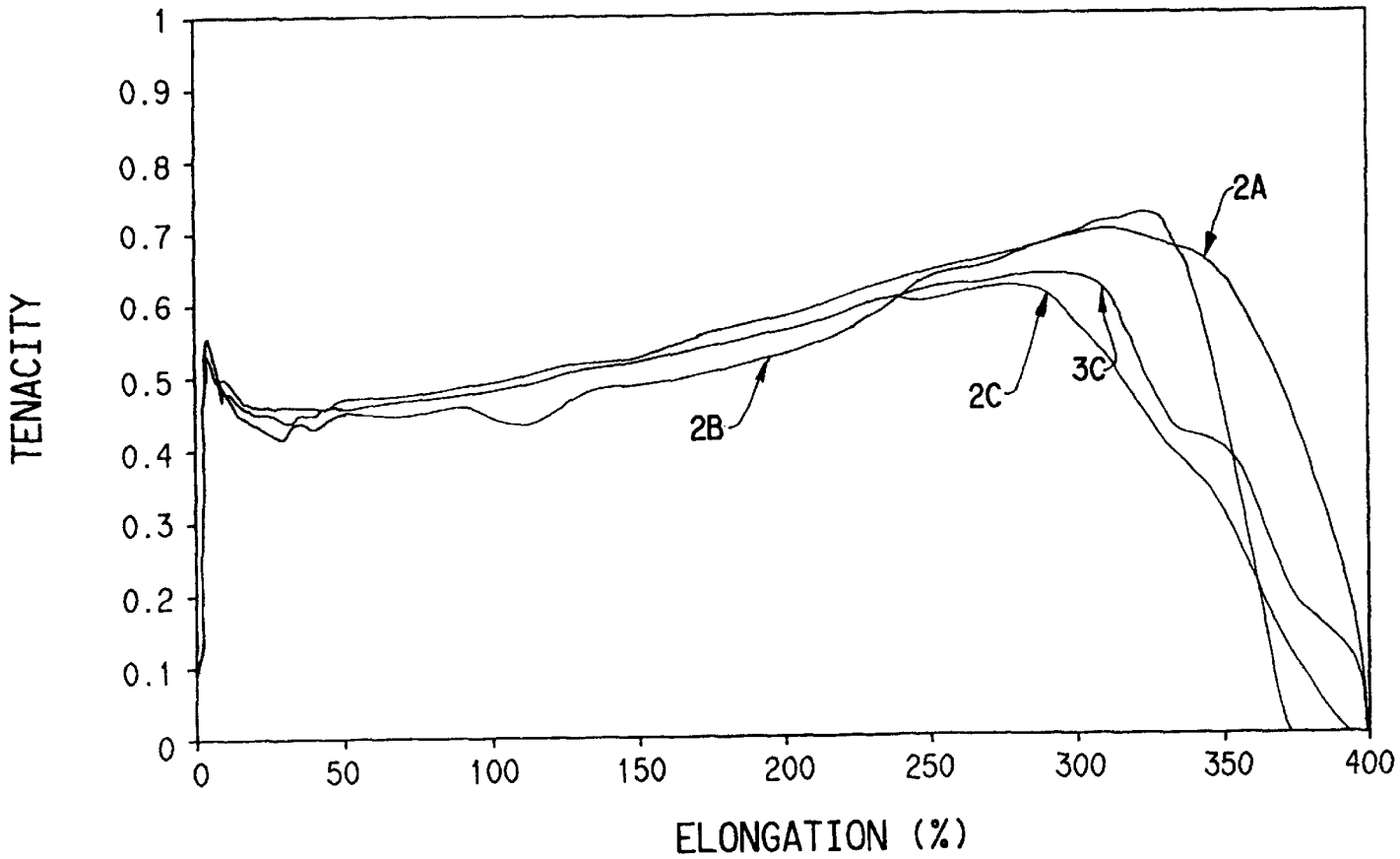

Stress/strain curves of single filaments of each type are shown in FIG. 4, together with a Curve 3C that is a stress-strain curve for a 6-grooved filament that is described in Example 3 hereinafter.

TABLE 2A

| Item | Cross-Section | Mod | Ten | $E_B$ % |
|---|---|---|---|---|
| 2A | Round | 16 | 0.63 | 320 |
| 2B | Hollow (7%) | 18 | 0.68 | 330 |
| 2C | SO (1.5) | 16 | 0.56 | 275 |

Eleven bobbins of the round filaments, 11 bobbins of the hollow filaments and 12 bobbins of the scalloped-oval filaments were combined to form a tow having a nominal blend ratio of 34% round, 33% hollow, and 33% scalloped-oval filaments with a total tow spun denier of 125,476 (139,418 dtex). This tow was drawn, crimped and relaxed essentially as described for Example 1, but at a draw ratio of 3.0× to give a drawn tow of approximately 47,000 denier (52,000 dtex) of an intimate blend containing these three differently-shaped crimped filaments (8.4 CPI, 3.3 CPcm, 16.7 CTU) with a nominal dpf of about 2.85 (3.2 dtex) whose filament properties are listed in Table 2B.

TABLE 2B

| Cross Section | Conc. Wt % | Mod | Ten | $E_B$ % |
|---|---|---|---|---|
| Round | 34 | 44 | 2.2 | 15 |
| Hollow | 33 | 49 | 2.3 | 12 |
| S. Oval | 33 | 47 | 2.3 | 17 |

Conventional finish was applied as in Example 1, and the tow was processed and scrutinized for Product Defects. It was surprising, in view of previous attempts with conventional filaments, that the sliver resulting from this Example of an intimate blend of three different cross-sections (round, hollow, and scalloped-oval), did not show any Product Defects of EFD, DDD, and SPL, despite having been drawn simultaneously.

How a fabric feels to a consumer can be critical for commercial viability. A fabric's aesthetics can be significantly affected by using mixtures of fibers of different cross-sections. But, previously, it has not been possible to draw simultaneously such mixtures of filaments from conventional homopolymers.

EXAMPLE 3

In Tables 3A and 3B, data are summarized for filaments as-spun and in a drawn tow of three differently-shaped filaments (same dpf) that were prepared and processed essentially as described in Example 2, but wherein the 2C scalloped-oval shape having only 4 grooves was replaced by filaments 3C having a 6-grooved cross-section, as described in U.S. Patent No. 5,626,961 (DP-6365-A). As explained in Example 2, a stress-strain curve for such a filament of 6-grooved cross-section has been included in FIG. 4 as Curve 3C, the round and hollow as-spun filaments being essentially the same for both Examples 2 and 3.

TABLE 3A

| Item | Cross-Section | Mod | Ten | $E_B$ % |
|---|---|---|---|---|
| 3A | Round | 16 | 0.63 | 320 |
| 3B | Hollow (7%) | 18 | 0.68 | 330 |
| 3C | 6-grooved | 16 | 0.60 | 300 |

TABLE 3B

| Cross-Section | Mod | Ten | $E_B$ % |
|---|---|---|---|
| Round | 44 | 2.2 | 15 |
| Hollow | 49 | 2.3 | 15 |
| 6-grooved | 47 | 2.3 | 16 |

The drawn tow (8.3 CPI, 3.3 CPcm, 19.9 CTU) of 2.85 nominal dpf (3.2 dtex) was processed and showed zero Product Defects (EFD, DDD, SPL).

EXAMPLE 4

Figure 5:
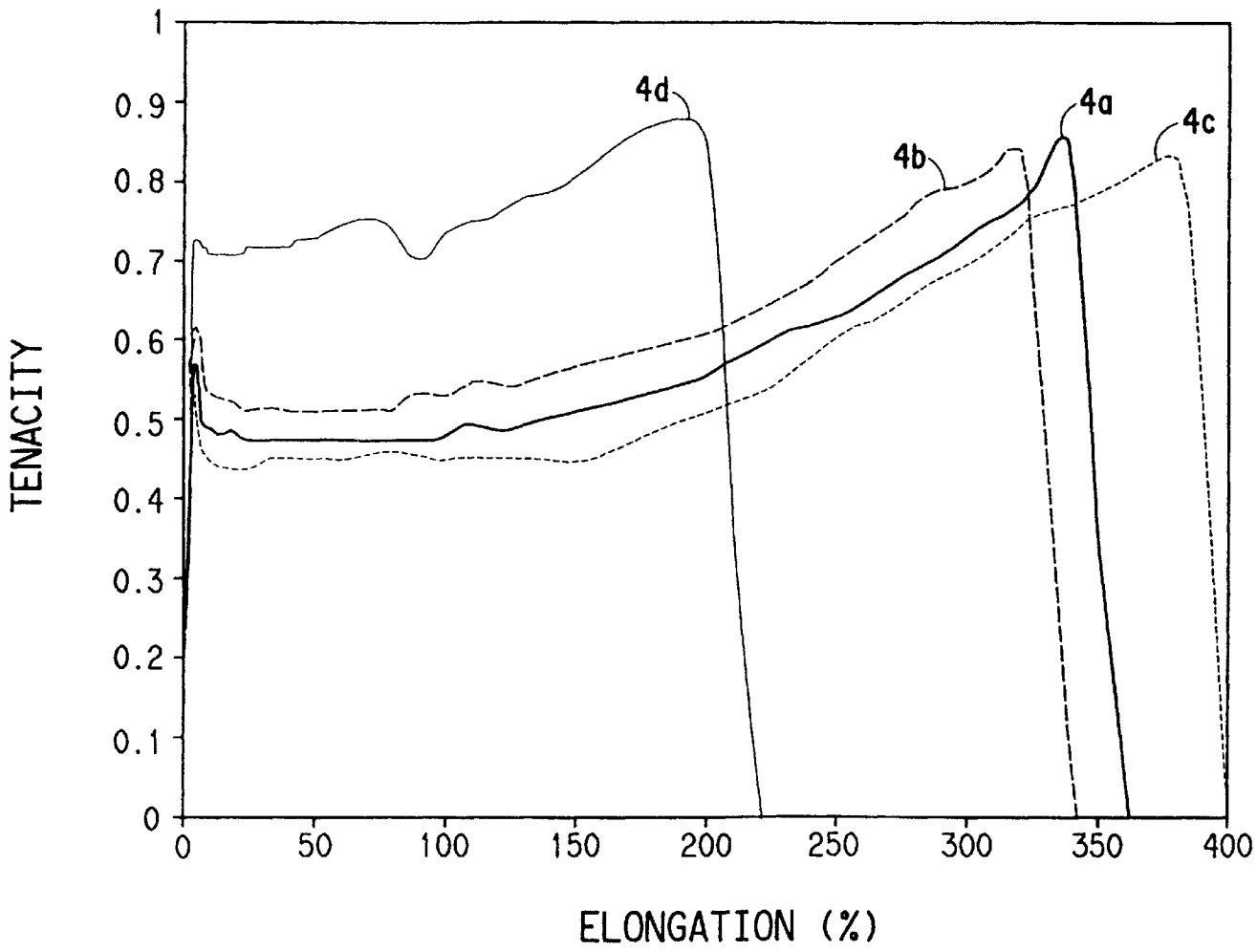

In Tables 4A and 4B, data are summarized similarly for filaments of four different shapes that were prepared essentially as described in Example 2. Round filaments were extruded at a rate of 70.4 lbs/hr (32 Kg/hr) from a 286 capillary spinneret; trilobal filaments were extruded at a rate of 44 lbs/hr (20 Kg/hr) from a 160-capillary spinneret, using an orifice shape essentially as described in Figure XI of U.S. Pat. No. 2,945,739; scalloped-oval (4 grooves) filaments were extruded at a rate of 110 lbs/hr (50 Kg/hr) from a 450-capillary spinneret and hollow filaments were extruded at a rate of 89.4 lbs/hr (40.6 Kg/hr) from a 363-capillary spinneret. Stress/strain curves of single filaments of these different cross sections are shown in FIG. 5.

TABLE 4A

| Item | Cross-Section | DPF | Mod | Ten | $E_B$ % |
|---|---|---|---|---|---|
| 4A | Round | 11.7 (13.0) | 21 | 0.67 | 314 |
| 4B | Trilobal (1.4) | 11.5 (12.8) | 22 | 0.65 | 266 |
| 4C | SO (1.5) | 11.4 (12.7) | 18 | 0.71 | 353 |
| 4D | Hollow (7%) | 11.6 (12.9) | 19 | 0.67 | 328 |

TABLE 4B

| Item | Cross-Section | DPF | Mod | Ten | $E_B$ % |
|---|---|---|---|---|---|
| 4A | Round | 4.9 (5.4) | 34 | 1.7 | 22 |
| 4B | Trilobal | 3.8 (4.2) | 47 | 2.5 | 13 |
| 4C | SO | 4.3 (4.7) | 37 | 1.9 | 18 |
| 4D | Hollow | 4.1 (4.6) | 41 | 2.3 | 17 |

Twenty bobbins of round filaments (66,924 denier, 74,360 dtex), thirty-five bobbins of trilobal filaments (64,400 denier, 71,555 dtex), four bobbins of scalloped-oval filaments (20,520 denier, 22,800 dtex), and five bobbins of hollow filaments (21,054 denier, 23,393 dtex) were combined to form a tow having nominal blend ratio of 39% round, 37% trilobal, 12% scalloped-oval and 12% hollow filaments with a total denier of 172,898 (192,108 dtex). The tow was drawn, crimped and relaxed essentially as described in Example 2 to give a drawn tow of approximately 64,490 denier (71,655 dtex) of an intimate blend containing these four differently-shaped crimped (8.9 CPI, 3.5 CPcm, 20 CTU) filaments—round, trilobal, scalloped-oval, and hollow—with a nominal 4.3 dpf (4.8 dtex). Filament properties are listed in Table 4B. The drawn dpfs were significantly different although the spun dpf s were very similar, which shows the difficulty of predicting beforehand what will happen when mixed filaments are drawn together.

Conventional finish was applied as in Example 1. The drawn tow was processed to show zero Product Defects (EFD, DDD, SPL).

A magnified photograph of part of this mixture of filaments is shown in Figure "1".

EXAMPLE 5

In Table 5, drawn filament properties are summarized similarly for filaments of only two differently-shaped drawn filaments from a drawn tow prepared essentially as described in Example 4 except that only two different cross-sections—round and trilobal—were combined similarly, in proportions of round fibers—51%, and trilobal fibers—49%.

TABLE 5B

| Item | Cross-Section | Conc. % | Doffs | DPF | Mod | Ten | $E_B$ % |
|---|---|---|---|---|---|---|---|
| 4A | Round | 51 | 20 | 4.5 (5.0) | 27 | 1.9 | 13 |
| 4B | Trilobal | 49 | 35 | 4.3 (4.8) | 39 | 2.1 | 15 |

The crimp was measured as 8.9 CPI, 3.5 CPcm and 22.5 CTU. The tow was processed to show zero Product Defects (EFD, DDD, SPL), despite the drawn dpfs and filament properties being significantly different from those in Table 4B. This confirms the difficulty of predicting behavior of filaments during drawing.

EXAMPLE 6

Figure 6:
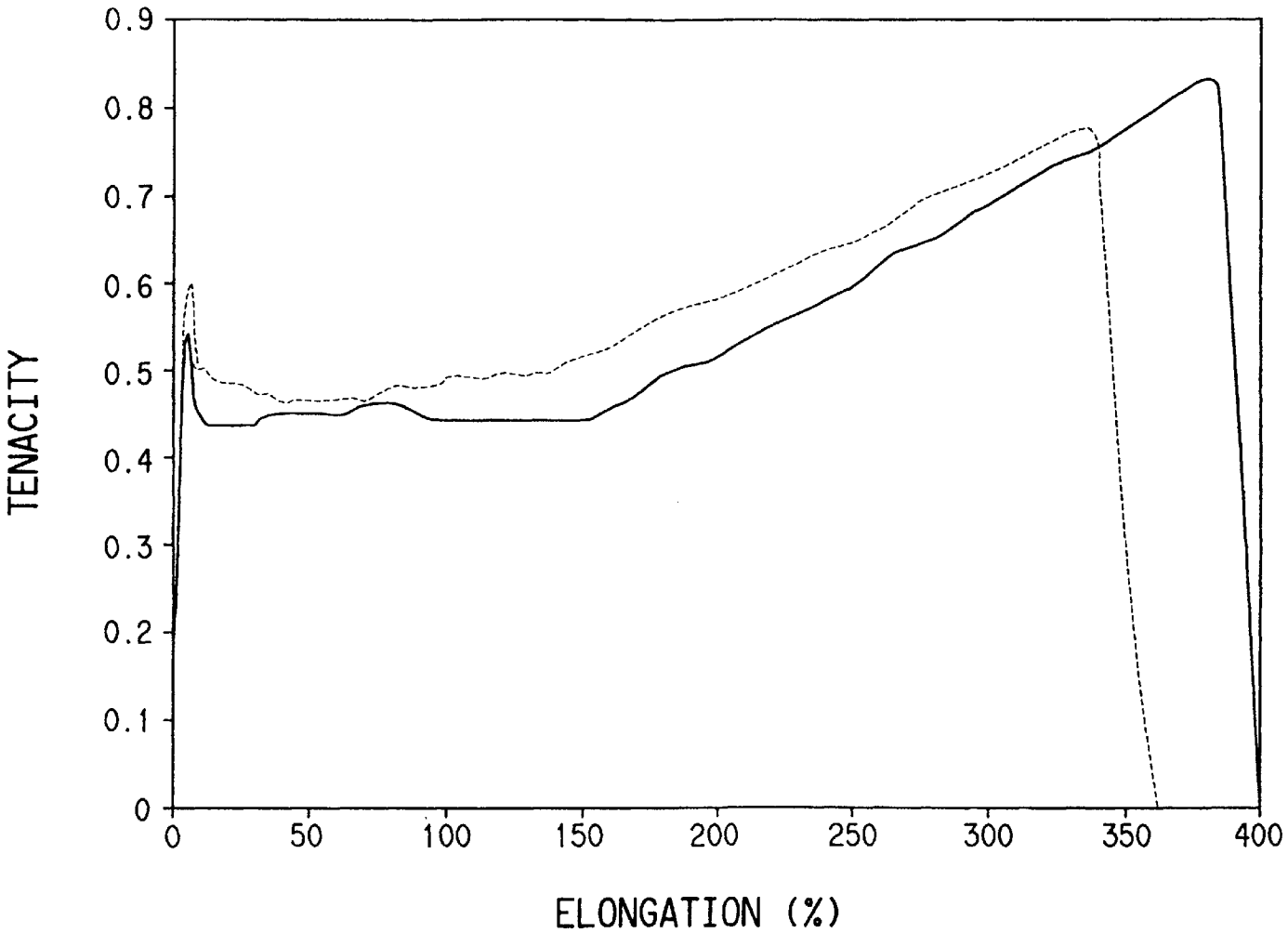

Filaments of round, trilobal, and scalloped-oval cross-section of two different deniers (higher dpf termed "SO-H" and lower dpf termed "SO-L"), were melt spun essentially as described for Example 4 (no hollow filaments being used in this Example); the SO-L filaments were extruded at a rate of 75 lbs/hr (34 Kg/hr) from a 450-capillary spinneret; the SO-H and the other filaments were as described for Example 4. The spun denier of the round, trilobal, and SO-H filaments were approximately the same while the SO-L were 7.9 dpf (8.8 dtex). The as-spun properties are indicated in Table 6A. Stress/strain curves of single filaments of both scalloped-oval types are shown in FIG. 6, the continuous line being for a SO-H higher denier filament, and the interrupted line being for a lower denier SO-L filament.

Twenty bobbins of round filaments, thirty-five bobbins of trilobal filaments and four bobbins of SO-H filaments (as for Example 4) were combined with five bobbins of SO-L filaments (17,775 denier, 19,750 dtex) to form a tow having a nominal blend ratio of 40% round, 38% trilobal, 12% SO-H and 10% SO-L with a total tow denier of 169,619 (188,466 dtex). Part of this tow was drawn, crimped and relaxed essentially as in Example 2 to give a drawn tow (8.7 CPI, 3.4 CPcm, 14.8 CTU) of approximately 57,018 denier (63,353 dtex) of an intimate blend containing round, trilobal, scalloped-oval higher dpf, all of 3.9 dpf (4.3 dtex) and scalloped-oval lower dpf of 2.6 dpf (2.9 dtex) whose filament properties are listed in the upper part of Table 6B. Another portion of the same tow was processed through another route, using in addition an annealer at 1450C, before the stuffer box crimper, and then relaxed at 1450C to give a drawn tow (11.6 CPI, 3.0 CPcm, 10.7 CTU) of filaments whose properties are listed in the lower part of Table 6B.

TABLE 6A

| Cross-Section | DPF | Mod | Ten | $E_B$ % |
|---|---|---|---|---|
| Round | 11.7 (13.0) | 21 | 0.67 | 314 |
| Trilobal (1.4) | 11.5 (12.8) | 22 | 0.65 | 266 |
| SO-H (1.5) | 11.4 (12.7) | 18 | 0.71 | 353 |
| SO-L (1.5) | 7.9 (8.8) | 20 | 0.69 | 316 |

TABLE 6B

| Cross-Section | Mod | Ten | $E_B$ % |
|---|---|---|---|
| Relaxed | | | |
| Round | 37 | 1.7 | 14 |
| Trilobal | 32 | 1.5 | 15 |
| SO-H | 37 | 1.9 | 18 |
| SO-L | 39 | 2.2 | 21 |
| Annealed | | | |
| Round | 41 | 2.0 | 11 |
| Trilobal | 32 | 1.9 | 12 |
| SO-H | 41 | 2.4 | 14 |
| SO-L | 41 | 2.5 | 15 |

Conventional finish was applied as in Example 1. Both drawn tows were processed and showed zero Product Defects (EFD, DDD, SPL), again despite the filaments having significantly different properties from those drawn in other Examples.

EXAMPLE 7

Mixed filaments, both of scalloped-oval cross-section were spun from the same spinneret essentially as described in Example 1, but using polymer as described in Example 2, the 516 large capillaries (located on the outer four rings of the spinneret) being of flow area 0.0002717 sq. in. (0.175 $mm^2$) to make the heavy dpf SO filaments. Table 7A shows as-spun properties obtained for the resulting light and heavy dpf filaments.

TABLE 7A

| Thruput/ lbs | Type | DPF | Mod | Ten | $E_B$ % |
|---|---|---|---|---|---|
| 92 (42) | Light (1.3) | 3.5 (3.9) | 12 | 0.6 | 175 |
| | Heavy (1.4) | 4.6 (5.2) | 11 | 0.7 | 291 |

Heavy (1.4) 4.6 (5.2) 11 0.7 291 Thirty-four bobbins were combined to form a tow with a nominal blend ratio of 40/60 light/heavy filaments. This tow was drawn at a ratio of 2.6X but otherwise drawn, crimped and relaxed essentially as described in Example 1 to give a drawn tow of approximately 56,000 denier (62,000 dtex) of an intimate blend containing lower and higher denier filaments, with a nominal dpf of about 1.85 (2.1 dtex), whose filament properties are listed in Table 7B.

TABLE 7B

| | Blend Conc. % | DPF | MOD | Ten | $E_B$ |
|---|---|---|---|---|---|
| Heavy (1.4) | 60 | 2.2 (2.5) | 40 | 1.8 | 12 |
| Light (1.3) | 40 | 1.4 (1.6) | 42 | 2.3 | 15 |

Conventional finish was applied as in Example 1. The tow (CPI 9.6, CPcm 3.8) was collected in a conventional tow box and sent to a mill for downstream processing, blending with wool for yarn conversion and then into fabrics, and processed very satisfactorily, showing zero Product Defects (EFD, DDD, SPL). This Example 7 is similar to Example 1 of U.S. Pat. No. 5,591,523 in that filaments of scalloped-oval cross-section of differing deniers were simultaneously drawn in the same bundle, but different in that in the present Example 7 both types of filaments were made by spinning through different capillaries in the same spinneret.

The absence of any such Product Defects in drawn mixed filament tow bundles according to the invention is very different from experience when drawing comparable mixed filament bundles of polyester homopolymer (2G-T) without any chain-brancher.

What is claimed is:

1. A process of forming a bundle of a mixture of different polyester filaments, comprising the steps of:

(a) melt spinning a chain-branched polymer to form a plurality of molten filamentary streams; and (b) quenching each molten filamentary stream to form a spun filament bundle comprising a mixture of different polyester filaments.

2. The process of claim 1, wherein the polymer is melt-spun through a plurality of capillaries of different cross-section to form a plurality of respective molten filamentary streams.

3. The process of claim 2, wherein the molten filamentary streams are quenched to form a spun filament bundle comprising a mixture of filaments of different cross-section.

4. The process of claim 1, wherein the polymer is melt-spun through a plurality of capillaries of different flow area to form a plurality of respective molten filamentary streams.

5. The process of claim 4, wherein the molten filamentary streams are quenched to form a spun filament bundle comprising a mixture of filaments of different denier per filament.

6. The process of any of claim 1, 3 or 5 wherein the filaments are combined to form a rope, and a plurality of ropes is drawn.

* * * * *